US005344364A

United States Patent [19]

Michlovic

[11] Patent Number: 5,344,364

[45] Date of Patent: Sep. 6, 1994

[54] CIRCULATION AIR DISTRIBUTION SYSTEM

[75] Inventor: John J. Michlovic, McMurray, Pa.

[73] Assignee: United Dominion Industries, Charlotte, N.C.

[21] Appl. No.: 993,598

[22] Filed: Dec. 21, 1992

[51] Int. Cl.[5] ..... F24F 7/04

[52] U.S. Cl. ..... 454/185; 454/266; 454/290; 454/317; 454/903

[58] Field of Search ..... 454/185, 186, 261, 262, 454/266, 289, 290, 317, 322, 330, 903

[56] References Cited

U.S. PATENT DOCUMENTS

| | | | |
|---|---|---|---|
| 2,182,686 | 8/1936 | Young . | |
| 2,729,426 | 1/1956 | Goemann . | |
| 2,729,429 | 1/1956 | Goemann | 454/185 X |
| 3,356,134 | 11/1965 | Sawyer | 454/185 X |
| 3,366,364 | 1/1968 | Curran | 454/185 X |
| 3,442,058 | 5/1969 | Naslund et al. | 454/185 |
| 4,872,397 | 10/1989 | Demeter et al. | 454/235 |

*Primary Examiner*—Harold Joyce
*Attorney, Agent, or Firm*—Reed Smith Shaw & McClay

[57] ABSTRACT

A circulation air distributing system for supplying fresh conditioned, hot or cold air through the use of cells metal cellular flooring. Distribution box inserts are uniformly distributed along the cellular flooring units prior to concrete placement. Selected distribution box inserts are activated to provide individual control means including diffuser means, for supplying individual workstations with fresh air at the volume, the temperature, and in the direction desired by the occupant. Air movement is from the floor surface upwardly toward the ceiling and into a return plenum space provided above the ceiling structure. In the event of a fire, selected diffuser means may be replaced by mask assembly which provide fresh, breathable air to an individual. Signal means activated on connection of the mask assembly to the control means, alerts the fireman as to the location where rescue is required.

11 Claims, 7 Drawing Sheets

CIRCULATION AIR DISTRIBUTION SYSTEM

BACKGROUND OF THE INVENTION

1. Field of the Invention

This invention relates to an air distribution system, and more particularly, to an air distribution system for supplying fresh conditioned air to individual office work spaces through cellular flooring.

2. Description of the Prior Art

An early air circulation system supplied conditioned air through individual cells of metal cellular flooring units, see U.S. Pat. No. 2,182,686 issued to J. H. YOUNG. In the YOUNG '686 arrangement, discharge outlets are provided, each associated with a single cell of the metal cellular flooring unit. The outlets may be provided in either the floor, the vertical walls, or partitions of different rooms throughout the building. The YOUNG '686 system may be termed a single duct air conditioning system wherein air of a predetermined temperature is supplied to all areas of the building.

Dual duct air conditioned systems employing two or three ducts to convey hot and cold conditioned air are described in U.S. Pat. Nos. 2,729,429 issued to GOEMANN and 3,356,134 issued to SAWYER.

GOEMANN '429 provides separate ducts conveying hot and cold air to the perimeter of a building where the hot and cold air streams are mixed within above-the-floor sill boxes to provide air of a desired temperature. The air is then discharged into the building. The GOEMANN '429 arrangement is concerned solely with air conditioning the perimeter of a building, or supplying only cold air at pre-selected locations in the interior of the building.

SAWYER '134 provides a dual duct air conditioning system where hot and cold air is supplied to above-the-floor window sill mixing boxes at the perimeter of the building and to individual above-the-floor interior mixing boxes uniformly spaced throughout the area of the floor. In the SAWYER '134 arrangement, hot air is provided only through a conduit extending adjacent to the perimeter of the building; whereas no hot air is introduced into the conduits extending through the interior of the building. Thus, the interior mixing boxes provide only cold air.

A personal environmental module for controlling the environment in a work space is describe in U.S. Pat. No. 4,872,397 issued to DEMETER, ET AL. The module is situated beneath the desk of the workstation and has a first inlet receiving room air and a second inlet receiving conditioned air from an underfloor duct. The housing includes two outlets communicating with vents situated on top of and at opposite ends of the desk, and from which conditioned air is discharged. Temperature control in the module is accomplished by separately controlling the amount of pre-conditioned air and room air to obtain the desired temperature.

SUMMARY OF THE INVENTION

The principal object of this invention is to provide a circulation air distributing system for today's "landscaped" office arrangements.

Another object of the invention is to provide a circulation air distribution system by which conditioned air is supplied at the floor surface and which is exhausted through a ceiling plenum thereby ensuring uniform temperature within each workstation.

A further object of this invention is to provide a circulation air conditioning system which supplies conditioned air to individual workstations such that the occupant of each workstation may control the volume, direction and temperature of the conditioned air entering the workstation.

Still another object of this invention is to provide a circulation air distribution system incorporating control means to which a mask assembly may be connected during a fire situation, to provide fresh, breathable air to individuals needing fresh air and/or waiting to be rescued.

In accordance with the present invention, a floor structure is provided having a floor upper surface and comprising a metal subfloor supporting an overlying layer of concrete. The metal subfloor includes at least one cellular metal flooring unit which presents spaced-apart first and second cells having a lengthwise trough therebetween. The first and second cells have confronting generally vertical webs presenting first and second cell outlet openings. A first source of air is provided for supplying the first cell with air at a first temperature. A second source of air is provided supplying the second cell with air at a second temperature. Control means are provided for controlling the volume of air being discharged from first and second outlet openings to the space above the floor structure. The control means is presented substantially flush with, and is operable accessible from said floor upper surface.

These objects and other advantages of the present invention will become more apparent by reference to the following detailed description and to the accompanying drawings in which:

DESCRIPTION OF PRESENTLY PREFERRED EMBODIMENT(S)

Figure 1:
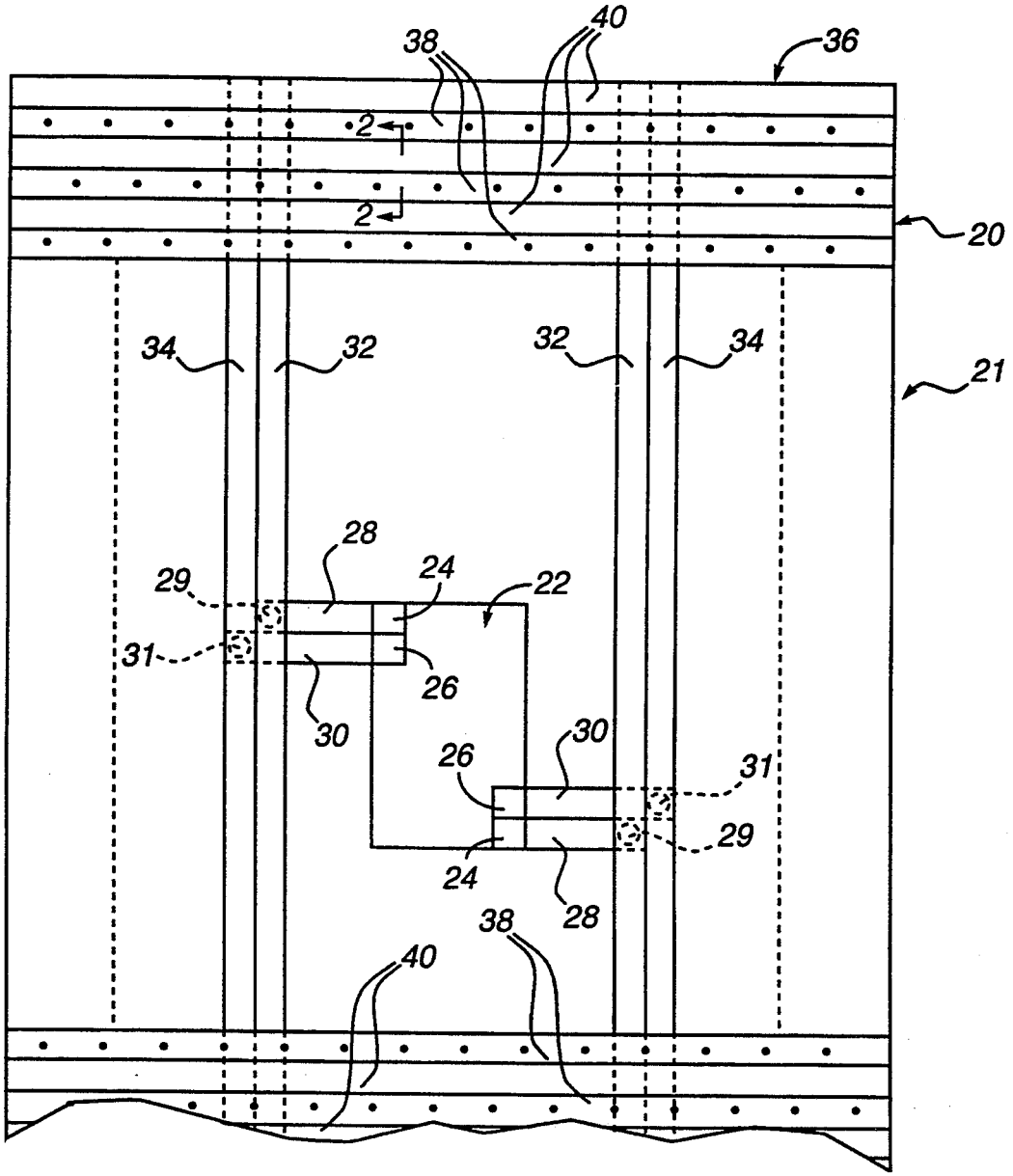
FIG. 1 is a fragmentary schematic plan view of a floor of a building prior to pouring an overlying layer of concrete over a metal subfloor which supports the concrete.
Figure 4:
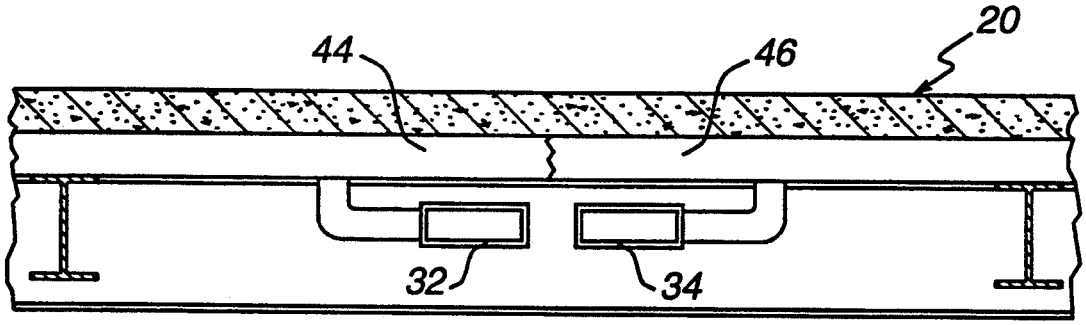
FIG. 4 is a cross-sectional view similar to FIG. 3, illustrating supply air ducts extending beneath the floor structure.

FIG. 1 schematically illustrates a building floor 20 having a core 22 through which condition air supply conduits 24, 26 extend vertically through the core from floor-to-floor of the building 21. The conditioned air supply ducts 24, 26 supply conditioned air at two different temperatures, $T_1$ and $T_2$. Duct extensions 28, 30 convey conditioned air from the air supply ducts 24, 26 to main supply ducts 32, 34 through connections 29, 31. As best shown in FIGS. 1 and 4, the main supply ducts 32, 34 extend beneath the floor 20 and transversely of a metal subfloor 36 comprising a component of the floor 20.

In the preferred arrangement, the metal subfloor 36 is assembled from metal cellular units 38, 40 which may alternate along the entire length of the floor 20, as illustrated in FIG. 1. The metal subfloor 36 is adapted to support an overlying layer of concrete 42.

Figure 2:
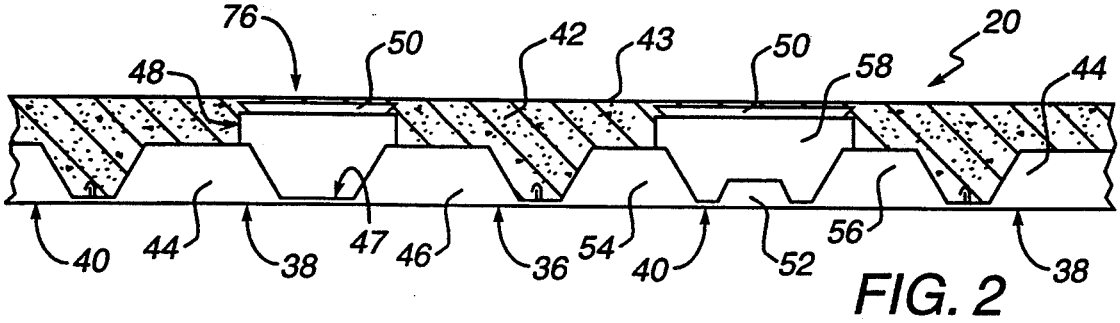
FIG. 2 is a cross-section view taken substantially along the line 2—2 of FIG. 1.

The cellular unit 38 (FIG. 2) presents two cells 44, 46 through which conditioned air at the temperatures $T_1$ and $T_2$are conveyed. The cellular unit 38 has a lengthwise trough 47 between the cells 44, 46. Enclosure means 48 are mounted at spaced locations along the length of the metal cellular unit 38 and which enclose outlet openings provided by the cells 44, 46. As is conventional, each enclosure 48 is provided with a protective cap 50, which is filled with a thin layer of the concrete 42. Access to the enclosure 48 is provided by fracturing the concrete within the protective cap 50, removing the broken concrete, and then removing the protective cap 50. The enclosure means 48 is a component of a distribution box or control means 76 hereinafter described.

Where electrification of the building floor 20 is required, the cellular unit 40 provides a central power cell 52 conveying high tension power wiring (not shown), a computer or signal cell 54 conveying computer or signal wiring (not shown), and a telephone cell 56 conveying telephone wiring (not shown). A preset insert 58 encloses access openings presented by the cells 52, 54 and 56. The preset insert 56 may comprise the insert disclosed in U.S. Pat. No. 4,603,523 issued to R. E. ALBRECHT ET AL—U.S. Pat. No. 4,603,523 being incorporated herein by reference. The insert 56 is provided with a protective cap 50 for the purpose explained above.

Figure 3:
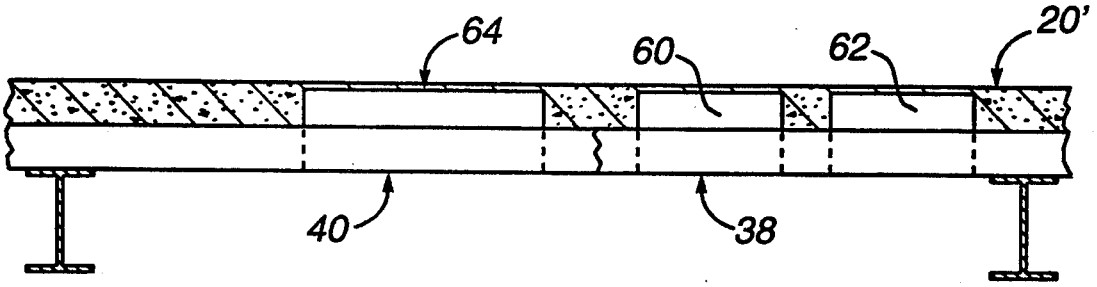
FIG. 3 is a transverse cross-sectional view of a floor structure illustrating the use of in-floor supply air ducts.

Referring to FIG. 3, the building floor 20 may incorporate in-floor ducts 60, 62 serving as first and second sources of air supplying air at different temperatures to cells 44, 46. To electrify the building floor 20', an underfloor electrical cable trench 64 is provided which extends transversely across the cells 52–56 of the metal cellular units 40. The underfloor electrical cable trench 64 preferably comprises that trench disclosed in U.S. Patent 3,721,051 issued to FRANK W. FORK—U.S. Pat. No. 3,721,051 being incorporated herein by reference.

Figure 5:
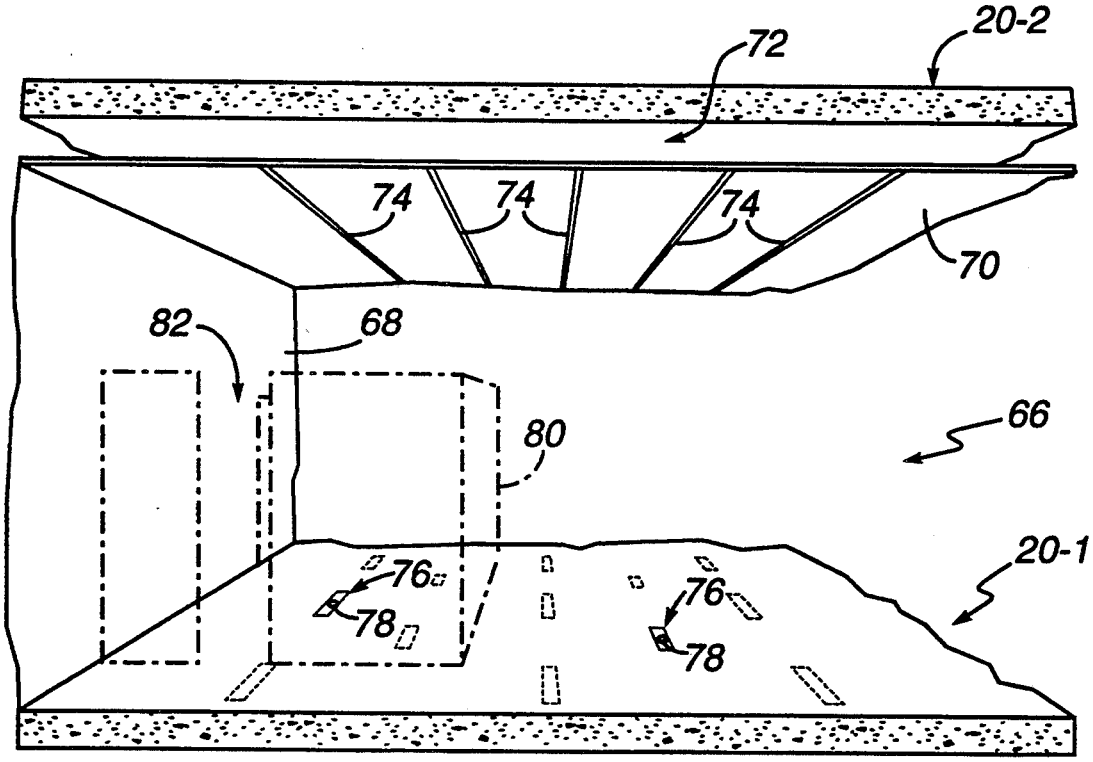
FIG. 5 is a fragmentary perspective view schematically illustrating a building floor utilizing the air distribution system of this invention.

Referring to FIG. 5, there is schematically illustrated room space 66 defined by the building floor 20-1, the wall 68, and the ceiling structure 70 which is spaced from the next floor 20-2 to provide a plenum space 72 therebetween. The ceiling structure 70 presents lengthwise openings through which exhaust air is returned to the plenum space 72 for recycling. In accordance with the present invention, the floor 20-1 presents control means 76, each associated with one of the preset enclosures 48 (not visible in FIG. 5). Each control means 76 presents diffuser means 78 for controlling the volume and direction of the conditioned air discharged from the control means 76. As shown, partition means 80 cooperates with the wall 68 to define a workstation 82 containing one of the control means 76 and diffuser means 78. Conditioned air of selected temperature issues from the diffuser means 78 into the workstation 82 and is exhausted through one or more of the lengthwise openings 74 presented by the ceiling structure 70 into the plenum space 72 for recycling. With this arrangement, smoking in a workstation or office is far less offensive to the nonsmoker since the directed air currents are away from the occupants. Rising smoke is not directed downward and re-mixed with room air as in prior air distribution systems.

Figure 6:
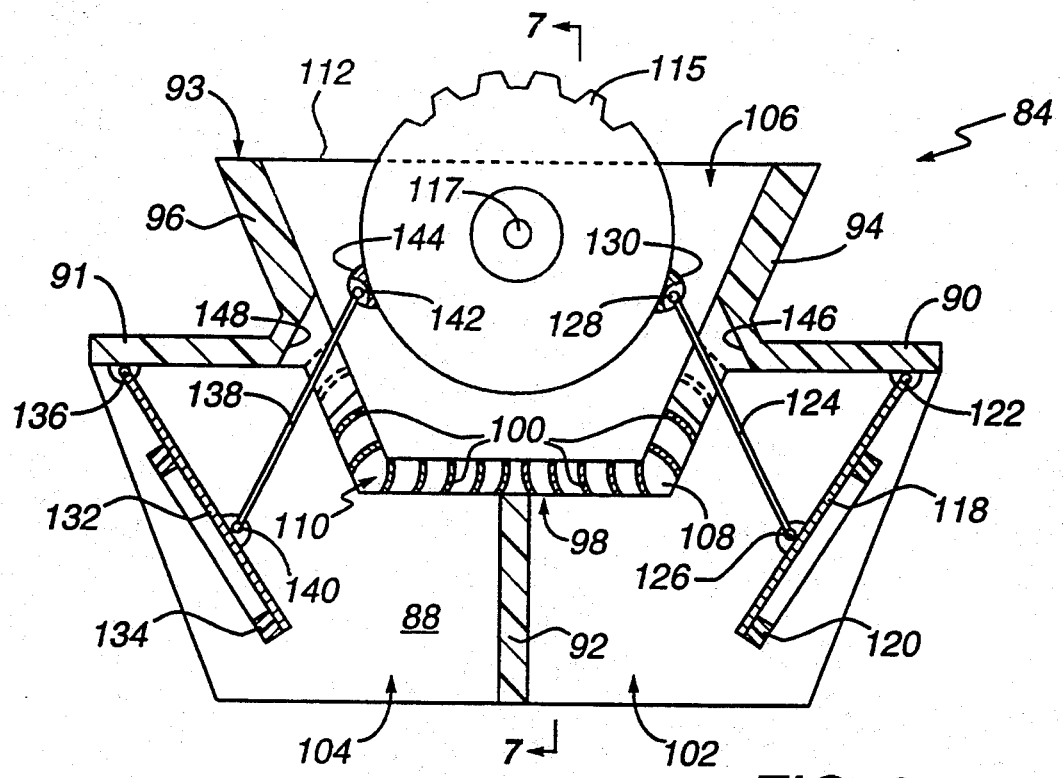
FIG. 6 is a cross-sectional view, taken along the line 6—6 of FIG. 7, illustrating distribution box insert means.
Figure 7:
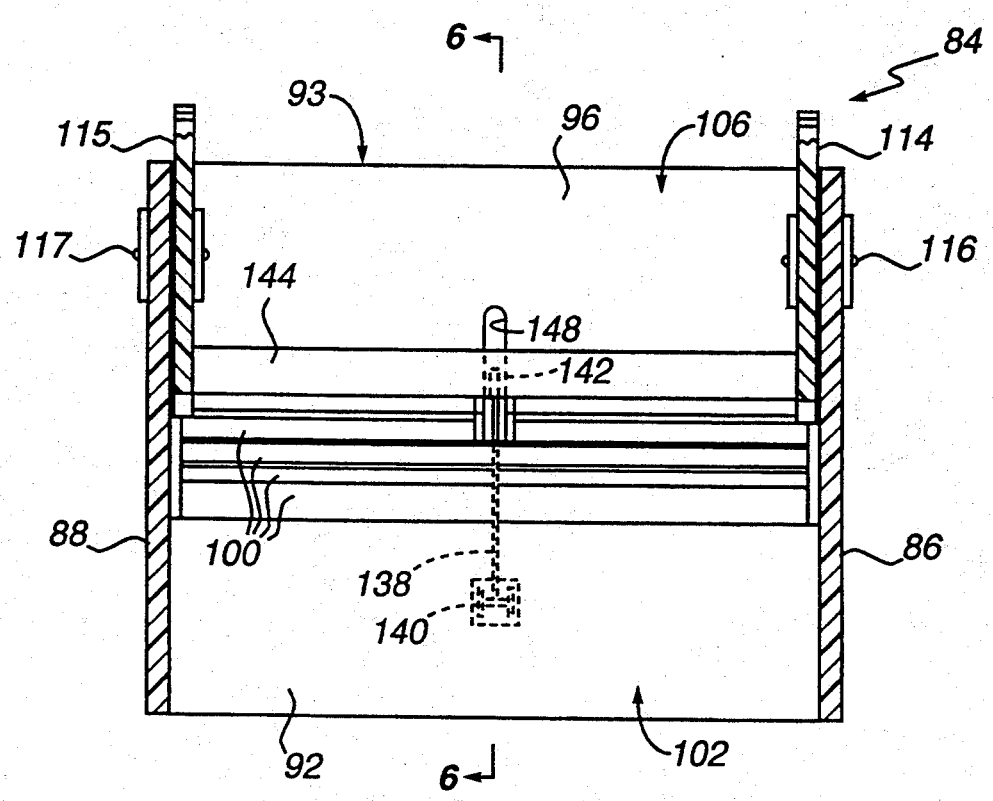
FIG. 7 is a cross-sectional view, taken along the line 7—7 of FIG. 6, further illustrating distribution box insert means.

The control means 76 (FIG. 5) of the present invention includes insert means 84 illustrated in FIGS. 6 and 7. The insert means 84 comprises vertical end walls 86, 88, top wall portions 90, 91 extending between the end walls 86, 88 and a vertical dividing wall 92. The insert means 84 additionally includes a cuplike structure 93 presenting diverging side walls 94, 96 extending upwardly from the top wall portions 90, 91 and having an open bottom 98 disposed beneath the top wall portions 90, 91; and an outlet chamber 106 presented above the top wall portions 90, 91.

The inlet chamber 102 is defined, in part, by the top wall portion 90, segments of the end walls 86, 88 and the vertical dividing wall 92. The inlet chamber 102 communicates with the outlet chamber 106 through a chamber outlet opening 108 containing the louvres 100.

The inlet chamber 104 is defined, in part, by the top wall portion 91, segments of the end walls 86, 88 and the vertical dividing wall 92. The inlet chamber 104 communicates with the outlet chamber 106 through a chamber outlet opening 110 containing the veins 100.

The outlet chamber 106 is defined by the diverging side walls 94, 96 and segments of the end walls 86, 88. The outlet chamber 106 has an open top 112.

The insert means 84 (FIG. 7) additionally includes control elements comprising spaced-apart adjustment wheels 114, 115 disposed within the outlet chamber 106 and pivotally connected at 116, 117 to the end walls 86, 88.

The inlet chamber 102 includes a damper 118 carrying a gasket 120. The damper 118 is pivoted at 122 to the top wall portion 94, for rotation about an axis parallel with the top wall portion 90. An operator arm 124 has one end pivoted at 126 to the damper 118 and an opposite end pivoted at 128 to a connecting arm 130 which extends between and is secured to the adjustment wheels 114, 115.

The inlet chamber 104 is provided with a damper 132 having a gasket 134. The damper 132 is pivoted at 136 to the lower face of the top wall portion 91. An operator arm 138 has one end pivoted at 140 to the damper 132 and an opposite end pivoted to connecting arm 144 which extends between and is secured to the adjustment wheels 114, 115.

It will be observed in FIG. 6 that the diverging walls 94, 96 each include a slot 146, 148, respectively, through which the operating arms 124 and 138 extend. The slots 146, 148 provide for movement of the operating arms 124, 138 as the adjustment wheels 114, 115 are rotated.

Figure 8:
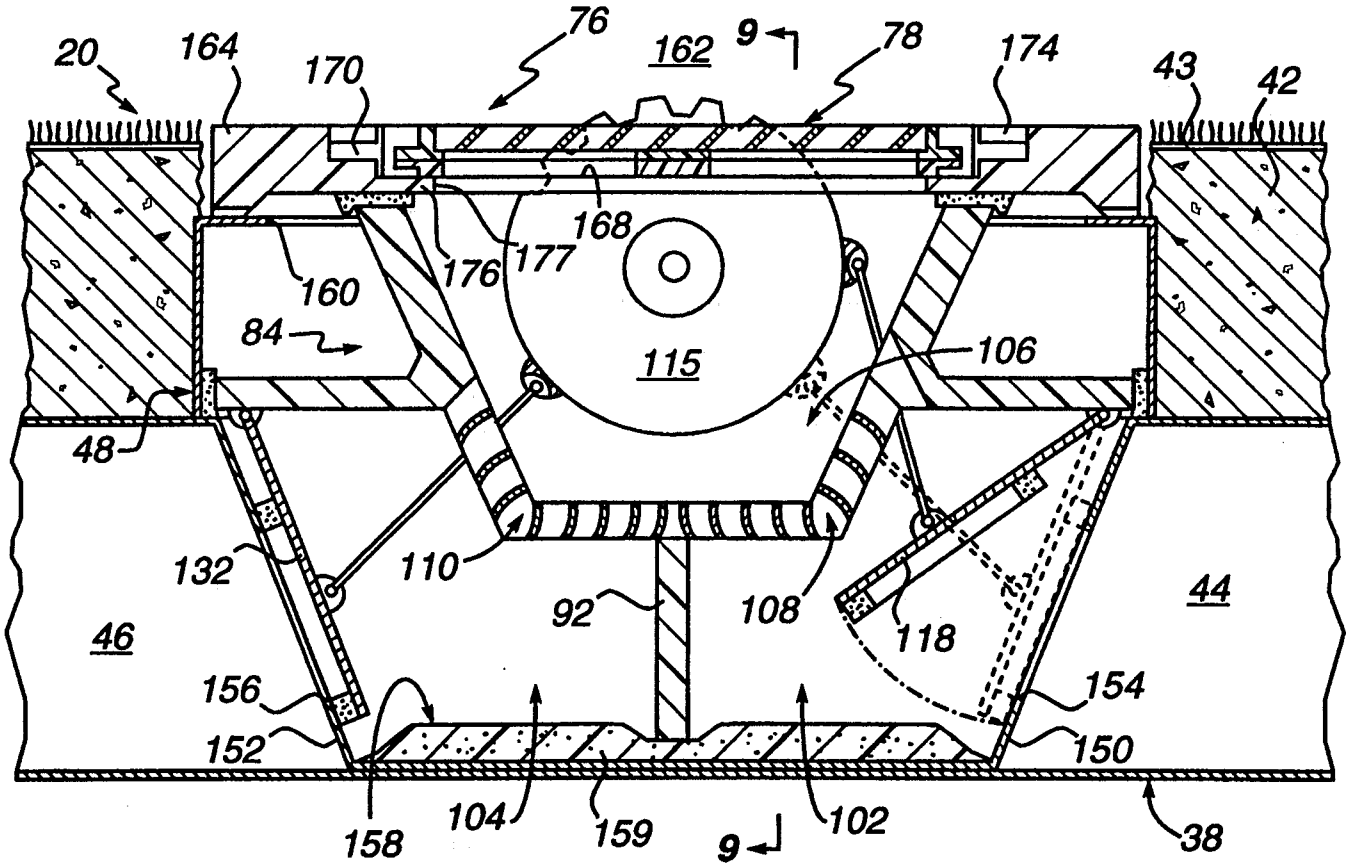
FIG. 8 is a cross-sectional view taken along the line 8—8 of FIG. 9 illustrating a distribution box or control means associated with adjacent cells of a metal cellular flooring unit.
Figure 9:
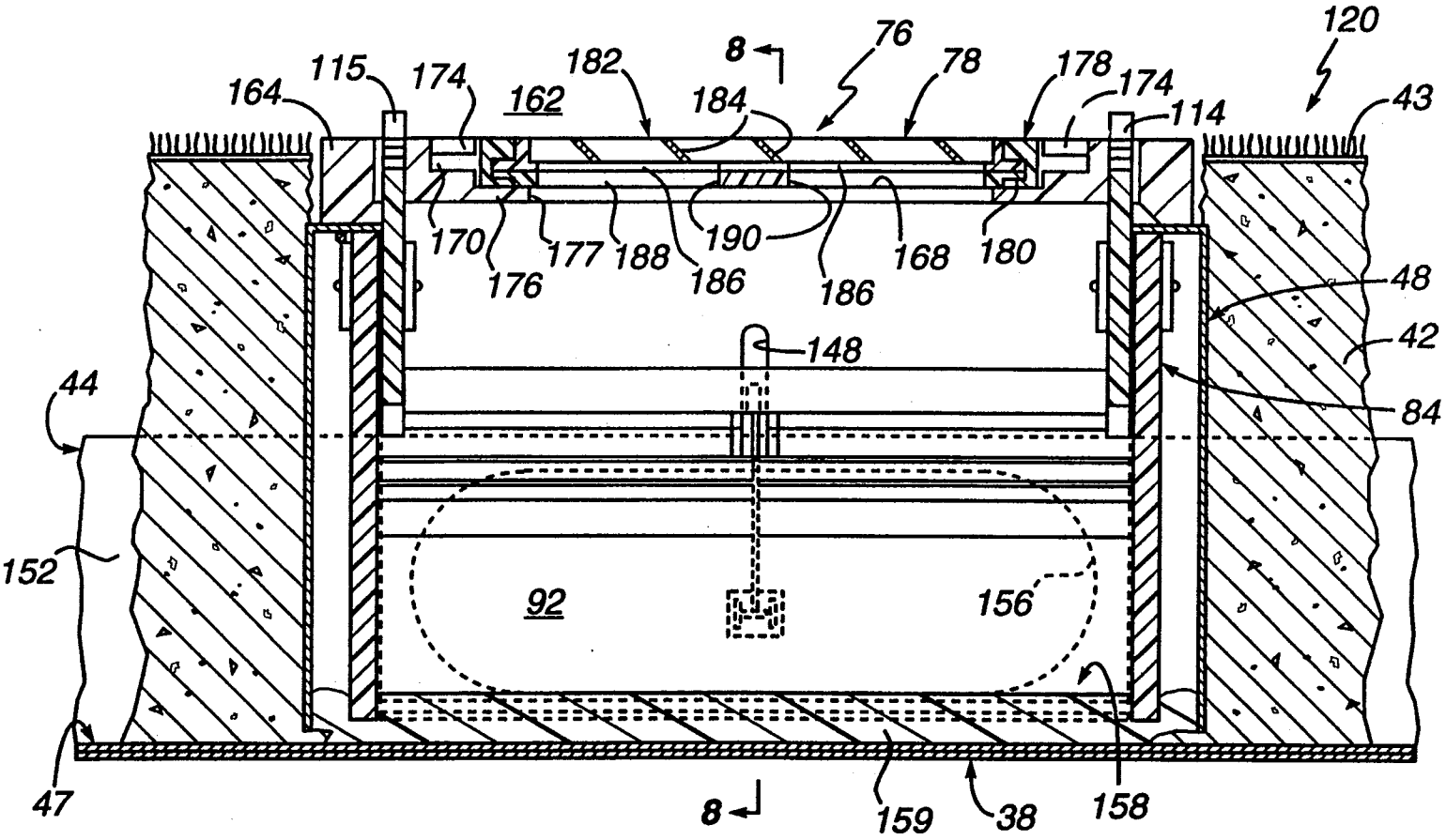
FIG. 9 is a cross-sectional view taken along the line 9—9 of FIG. 8 further illustrating the control means.

It will be observed in FIG. 8 that the first and second cells 44, 46 are spaced-apart and present confronting generally vertical webs 150, 152 having first and second cell outlet openings 154, 156, respectively. The cells 44, 46 communicate with the inlet chambers 102, 104 through the cell outlet openings 154, 156. As seen in FIGS. 8 and 9, the enclosure means 48 encloses a portion 158 of the lengthwise trough 47 which includes the first and second cell outlet openings 154, 156. The enclosure means 48 presents a central outlet opening 160 proximate to the floor upper surface 43.

The insert means 84 resides within the portion 158 of the lengthwise trough 47 and is arranged such that the dampers 118, 132 alternately close and open the first and second cell outlet openings 154, 156, thereby to control or proportion the amount of air being discharged from the first and second cells 44, 46. The air from the inlet chambers 102, 104 passes through the chamber they are mixed and ultimately discharged through the diffuser means 78 into the workstation space 162 above the floor structure 20. The insert means 84 preferably rests on a pad 159 comprised of a flexible, sound absorbing, fire resistant material.

Figure 10:
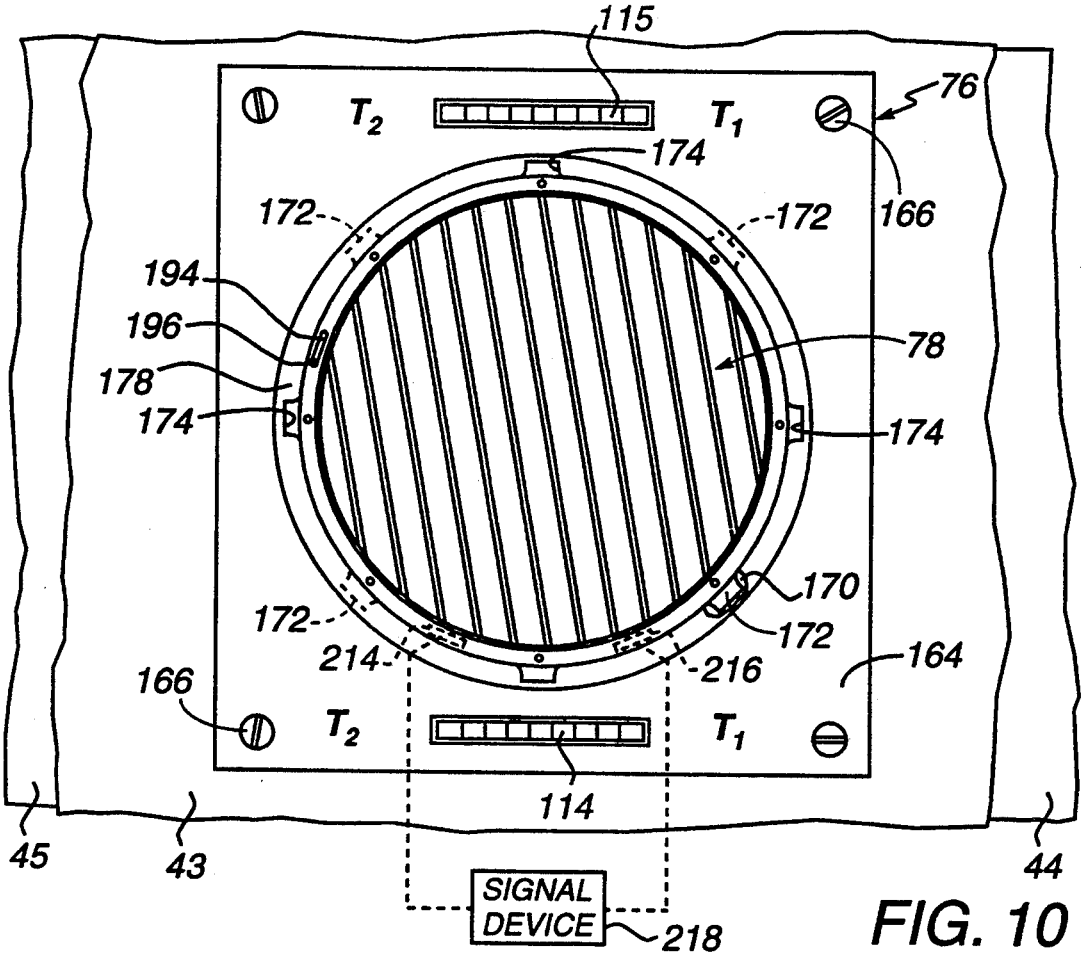
FIG. 10 is a plan view of the control elements of the present control means.

Referring to FIGS. 8 through 10, the control means 76 incorporates a finishing plate 164 which is secured to the top of the enclosure means by fasteners 166 (FIG. 10). The plate 164 includes a circular depression 168 surrounded by a perimeter groove 170. The diffuser means 78 is detachably received in the depression 168 by introducing the tabs 172 presented at the perimeter thereof into slots 174 presented by the finishing plate 164 and at the perimeter of the depression 168. Rotation of the diffuser means 78 places the tabs 172 within the slot 170, as clearly shown in FIG. 10.

As shown in FIG. 8 and 9, the finishing plate 164 presents an annular shoulder 176 which supports the diffuser means 78. The annular shoulder 176 defines an outlet opening 177, which allows the mixed air to pass from the outlet chamber 106 through the diffuser means 78 into the space 162 above the floor 20.

Figure 11:
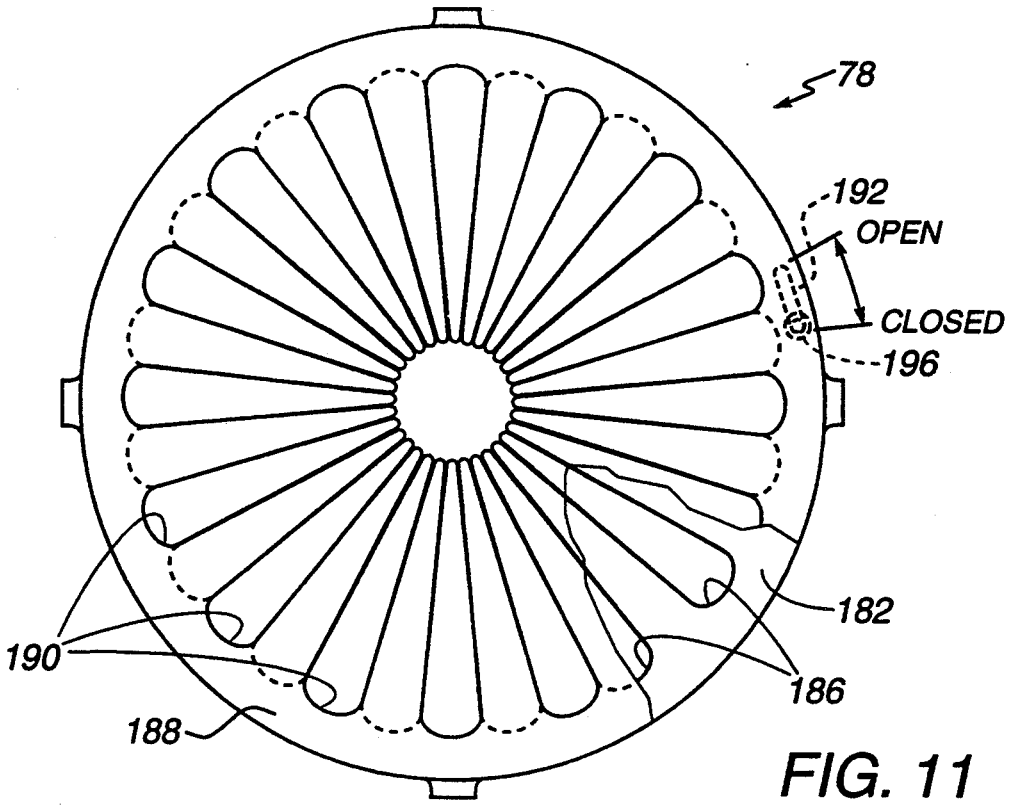
FIG. 11 is a plan view of the bottom of the two-piece diffuser means, with part broken away to show detail.

As shown in FIG. 9, the diffuser means 78 comprises an annular member 178 having an annular slot 180. Rotatable within the slot 180 is a top member 182 having directional vanes 184 and radial slot 186; and a bottom member 188 having complimentary radial slots 190. The top and bottom members 182, 188 are rotatable relative to each other between positions which render the diffuser means 78 in a closed and open condition. When the radial slots 186, 190 are offset relative to each other as shown in FIG. 11, the diffuser means 78 is in a closed condition and no conditioned air is discharged. When the radial slots 186, 190 are aligned, as shown in FIG. 9, conditioned air is discharged from the diffuser means 78.

To this end, the top member 182 has an arcuate slot 192 (FIG. 11) and the annular member 178 has a complimentary arcuate slot 194 (FIG. 10). An operating arm 196 secured to the bottom member 188, projects upwardly through the slots 192, 194 and is accessible from the upper surface 43 of the building floor 20 (FIG. 10). In FIG. 11, the arm 196 is shown in disposed in the closed position at one end of the slot 192 wherein the slots 182, 190 offset relative to each other. Movement of the arm 196 to the opposite end of the slot 192 will rotate the bottom member 188 such that the radial slots 190 thereof are aligned with the radial slots 186 of the top member 182.

Figure 12:
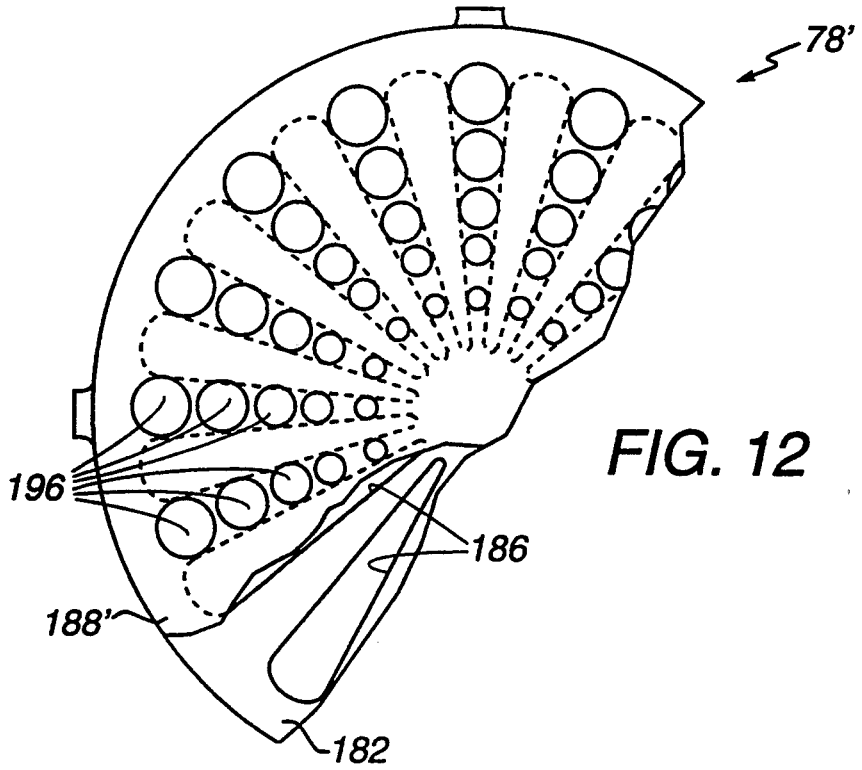
FIG. 12 is a fragmentary plan view of the bottom of a two-piece diffuser means, illustrating an alternative embodiment.

FIG. 12 illustrates an alternative embodiment of the diffuser means designated generally by the numeral 78', wherein each slot of the bottom member 188' is replaced by a series of apertures 198 of decreasing diameter. The aperture 198 are alignable with the slots 186 to allow discharge of conditioned air.

As shown in FIGS. 8–10, the control means 76 includes controls, such as, the adjustment wheels 114, 115 for regulating the temperature of the air being discharged through the diffuser means 78, and the diffuser means 78 for controlling the direction and volume of the air being discharged, all of which are exposed at the floor upper surface 43. Thus, the control means 76 is operable from the floor upper surface 43.

Figure 13:
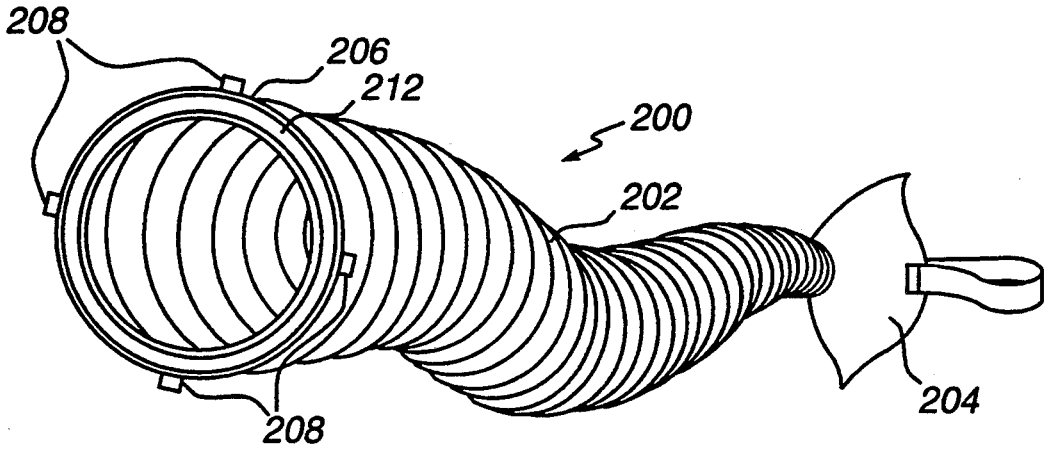
FIG. 13 is a schematic illustration of a mask assembly.

In the event of a building fire, it would be highly desirable to provide some means of supplying fresh, breathable air to an individual for life-sustaining purposes. To this end, FIG. 13 illustrates a mask assembly 200 comprising a telescoping hose 202 having a mask 204 connected to one end thereof and a connector ring 206 connected to the opposite end thereof. The connector ring 206 presents tabs 208. As explained above, the diffuser means 78 can be removed by rotating the same to align the tabs 172 thereof with the slots 174 and then removing the diffuser means 78. The tabs 208 may then be inserted into the slots 74 and the hose rotated to connect the mask assembly 200 to the finishing plate 164 as shown in FIG. 13. The annular inner face of the connector ring 206 may be provided with a metallic strip 212. When the connector ring 206 is connected to the finishing plate 164, the metallic strip 212 will make a connection across contacts 214, 216 (FIG. 10) to activate a signal device 218 for alerting firemen of the location where rescue is required.

Figure 14:
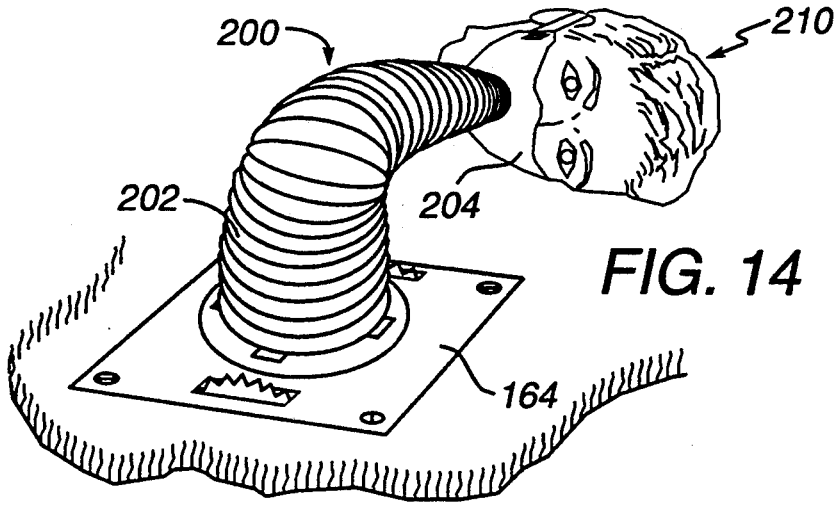
FIG. 14 is a fragmentary perspective view illustrating the mask assembly connected to the present control means during a fire situation and being utilized by an individual requiring fresh air and/or awaiting rescue.

An individual breathing fresh air provided by the present system is schematically illustrated in FIG. 14.

I claim:

1. In a floor structure having a floor upper surface, a space above said upper floor surface, and comprising a metal subfloor supporting an overlying layer of concrete, the combination comprising:

said metal subfloor including a cellular metal flooring unit presenting spaced-apart first and second cells having a lengthwise trough therebetween, said first and second cells having confronting generally vertical webs, and first and second cell outlet openings in said first and second cells;

a first source of air supplying said first cell with air at a first temperature;

a second source of air supplying said second cell with air at a second temperature;

control means for controlling the volume and the temperature of air being discharged from said first and second outlet openings to said space above said floor structure, said control means being substantially flush with and operable from said floor upper surface.

2. The floor structure as defined in claim 1 including:

enclosure means enclosing a portion of said lengthwise trough including said first and second cell outlet openings, said enclosure means having a central outlet opening proximate to said floor upper surface; and diffuser means at said central outlet opening and substantially flush with said floor upper surface, directing air discharged from said enclosure means into said space above said floor structure.

3. The floor structure as defined in claim 2 including:

insert means dividing said portion of said lengthwise trough into (a) adjacent inlet chambers, each communicating with one of said first and second cell outlet openings, said adjacent inlet chambers having chamber outlet openings; and (b) an outlet chamber disposed beneath said diffuser means and communicating with said adjacent inlet chambers through said chamber outlet openings.

4. The floor structure as defined in claim 1 including conduit means extending beneath said floor structure for conveying said first source of air and said second source of air, respectively, to said first cell and to said second cell.

5. The floor structure as defined in claim 1 including conduit means extending transversely across said metal cellular flooring unit and embedded within said overlying layer of concrete for conveying said first source of air and said second source of air, respectively, to said first cell and to said second cell.

6. The floor structure as defined in claim 1 including a mask assembly connected to said control means and comprises:

a telescoping hose having one end connected to said control means and a remote end; and a mask connected to said remote end of said telescoping hose, whereby in the event of a fire, said mask is used to provide fresh, breathable air to an individual waiting to be rescued.

7. The floor structure as defined in claim 6 including:

signal means activated on connection of said mask assembly to said control means for signaling the location where said mask assembly is being used.

8. In a floor structure having a floor upper surface and comprising a metal subfloor supporting an overlying layer of concrete, the combination comprising:

said metal subfloor including at least one cellular metal flooring unit presenting spaced-apart first and second cells having a lengthwise trough therebetween, said first and second cells having confronting generally vertical webs, and first and second cell outlet openings in said first and second cells;

a first source of air supplying said first cell with air at a first temperature;

a second source of air supplying said second cell with air at a second temperature;

enclosure means enclosing a portion of said lengthwise trough including said first and second cell outlet openings, and having a central outlet opening proximate to said floor upper surface;

diffuser means at said central outlet opening and substantially flush with said floor upper surface for directing air discharged from said enclosure means into the space above said floor structure; and valve means within said enclosure means for controlling the amount of air being discharged from said first and second cell outlet openings through said diffuser means to the space above said floor structure.

9. The floor structure as defined in claim 8 including:

insert means dividing the interior of said trough space into (a) adjacent inlet chambers, each communicating with one of said first and second cell outlet openings, said adjacent inlet chambers having chamber outlet openings; and (b) an outlet chamber disposed beneath said diffuser means and communicating with said adjacent inlet chambers through said chamber outlet openings.

10. In a floor structure having a floor upper surface, a space above said floor upper surface, and comprising a metal subfloor supporting an overlying layer of concrete, the combination comprising:

said metal subfloor including at least one cellular metal flooring unit presenting spaced-apart first and second cells having a trough therebetween, said first and second cells having confronting generally vertical webs, and sets of first and second cell outlet openings uniformly spaced along the length of said first and second cells;

a first source of air supplying said first cell with air at a first temperature;

a second source of air supplying said second cell with air at a second temperature;

control means, one for each said set, for controlling the volume and the temperature of air being discharged from said first and second cell outlet openings to said space above said floor structure, each said control means having control elements substantially flush with and operable from said floor upper surface.

11. The floor structure as defined in claim 10 including:

enclosure means enclosing a portion of said lengthwise trough including said first and second cell outlet openings, said enclosure means having a central outlet opening proximate to said floor upper surface; and diffuser means at said central outlet opening and substantially flush with said floor upper surface, directing air discharged from said enclosure means into the space above said floor structure.

* * * * *